US008726552B2

(12) United States Patent
Larsen

(10) Patent No.: US 8,726,552 B2
(45) Date of Patent: May 20, 2014

(54) ADAPTER FOR HITCH MOUNTED SIGN

(75) Inventor: Christopher M. Larsen, Farmington Hills, MI (US)

(73) Assignee: Marketing Display, Inc., Farmington Hills, MI (US)

( * ) Notice: Subject to any disclaimer, the term of this patent is extended or adjusted under 35 U.S.C. 154(b) by 99 days.

(21) Appl. No.: 13/368,904

(22) Filed: Feb. 8, 2012

(65) Prior Publication Data

US 2012/0204454 A1 Aug. 16, 2012

Related U.S. Application Data

(60) Provisional application No. 61/441,783, filed on Feb. 11, 2011.

(51) Int. Cl.
*G09F 21/04* (2006.01)

(52) U.S. Cl.
USPC ..... 40/591; 224/509

(58) Field of Classification Search
USPC ..... 40/606.14, 607.04, 607.08; 224/509; 248/125.8, 161, 407, 159, 157; 403/91, 403/92, 95, 109.2; 135/139, 140, 141, 142
See application file for complete search history.

(56) References Cited

U.S. PATENT DOCUMENTS 4,548,379 A * 10/1985 Seely et al. ..... 248/624
4,569,499 A * 2/1986 Seely ..... 248/624
4,576,395 A 3/1986 Longoria
4,725,027 A * 2/1988 Bekanich ..... 248/125.8
4,786,025 A * 11/1988 Shuman ..... 248/558
5,454,496 A 10/1995 Sumida, Jr. et al.
5,525,000 A * 6/1996 Belobraydich et al. ..... 403/102
5,641,237 A * 6/1997 Albert et al. ..... 403/372
5,664,717 A 9/1997 Joder
5,752,636 A 5/1998 Manley
5,845,832 A 12/1998 Eichmann
5,950,617 A 9/1999 Lorenz
5,950,890 A 9/1999 Darby
5,979,094 A 11/1999 Brafford, Jr.
6,007,033 A 12/1999 Casson et al.
6,027,134 A 2/2000 Hart et al.
6,079,136 A 6/2000 Kozlarek
6,152,675 A 11/2000 Compton
6,164,508 A 12/2000 van Veenen
6,496,123 B2 12/2002 Brinkman
6,517,134 B2 2/2003 Armstrong
6,553,697 B1 4/2003 Pichan
6,554,235 B1 * 4/2003 Fortier ..... 248/122.1
6,623,025 B2 9/2003 McCoy et al.
6,643,963 B2 11/2003 Beller (Continued)

*Primary Examiner* — Shin Kim
(74) *Attorney, Agent, or Firm* — Harness, Dickey & Pierce, P.L.C.

(57) ABSTRACT

A sign mounting adapter system includes a hitch extension tube. A sign orientation post connected and oriented perpendicular to the hitch extension tube has a longitudinal axis. A sign support post is axially and rotatably received on the sign orientation post. The sign support post has a longitudinal axis co-axially aligned with the sign orientation post longitudinal axis, and a receiving bore perpendicular to the sign support post longitudinal axis. Multiple orientation bores extend through the sign orientation post, each oriented at a first angle to proximate orientation bores and perpendicular to the orientation post longitudinal axis. A retention assembly is releasably and co-axially received in the receiving bore and one of the orientation bores. The retention assembly releasably connects the sign support post to the sign orientation post to permit selection of a sign support post axial angle of rotation to the sign orientation post.

29 Claims, 10 Drawing Sheets

(56) References Cited

U.S. PATENT DOCUMENTS

| | | | | |
|---|---|---|---|---|
| 6,722,380 | B1 | 4/2004 | Hafer | |
| 6,734,792 | B1 | 5/2004 | McElveen | |
| 7,347,017 | B2 | 3/2008 | Shaffer, Jr. | |
| 7,458,554 | B1 * | 12/2008 | Levin et al. | 248/408 |
| 7,503,135 | B2 | 3/2009 | Chafin | |
| 7,585,572 | B2 * | 9/2009 | Hattori | 428/658 |
| 2010/0058635 | A1 * | 3/2010 | Knapp et al. | 40/607.01 |
| 2010/0109287 | A1 * | 5/2010 | MacDougall | 280/491.1 |
| 2010/0117333 | A1 | 5/2010 | Ceccarelli et al. | |

* cited by examiner

ADAPTER FOR HITCH MOUNTED SIGN

CROSS-REFERENCE TO RELATED APPLICATIONS

This application claims the benefit of U.S. Provisional Application No. 61/441,783, filed on Feb. 11, 2011. The entire disclosure of the above application is incorporated herein by reference.

FIELD

The present disclosure relates to vehicle trailer hitch mounted sign systems.

BACKGROUND

This section provides background information related to the present disclosure which is not necessarily prior art.

Vehicles such as trucks, pickup trucks, emergency vehicles and construction vehicles commonly are adapted to support a sign warning passing vehicles of specific roadway conditions. These signs are commonly used for temporary conditions that take the place of permanent roadway or highway signs. Because the vehicle needs to be moved between different locations, common vehicle sign support systems require the sign to be detached prior to vehicle travel. In addition, common sign support systems that are adapted to be connected to a hitch mount of the vehicle are fixed in their orientation with respect to the vehicle, and therefore are not always oriented at an optimum viewing angle for a person in a passing or observer vehicle. For this reason, common warning signs used in construction areas or emergency areas are removed from the vehicle and are free standing. This requires additional time to set up and disassemble the sign.

SUMMARY

This section provides a general summary of the disclosure, and is not a comprehensive disclosure of its full scope or all of its features.

According to several embodiments an adapter for a hitch mounted sign of the present disclosure includes a hitch extension tube. A sign orientation post is connected to the hitch extension tube. A sign support post is co-axially disposed on and rotatably supported by the sign orientation post to permit selection of an axial angle of rotation of the sign support post with respect to the sign orientation post.

According to other embodiments, a sign mounting adapter system includes a hitch extension tube. A sign orientation post is connected to and oriented perpendicular to the hitch extension tube, the sign orientation post having a sign orientation post longitudinal axis. A sign support post is co-axially and rotatably received on the sign orientation post, the sign support post having a sign support post longitudinal axis co-axially aligned with the sign orientation post longitudinal axis and a retention assembly receiving bore oriented perpendicular to the sign support post longitudinal axis. Multiple orientation bores extending through the sign orientation post, individual ones oriented at a first angle with respect to a proximate one of the orientation bores, and each is oriented perpendicular to the orientation post longitudinal axis. A retention assembly is releasably and co-axially received in the retention assembly receiving bore and one of the orientation bores. The retention assembly releasably connects the sign support post to the sign orientation post to permit selection of an axial angle of rotation of the sign support post with respect to the sign orientation post.

According to further embodiments, a sign mounting adapter system includes a hitch extension tube adapted for releasable connection to a hitch receiver of a vehicle. A sign orientation post is fixed to and oriented perpendicular to the hitch extension tube, the sign orientation post having a sign orientation post longitudinal axis. A sign support post is co-axially and rotatably received on the sign orientation post. The sign support post has a sign support post longitudinal axis co-axially aligned with the sign orientation post longitudinal axis and a retention assembly receiving bore oriented perpendicular to the sign support post longitudinal axis. Multiple orientation bores extend through the sign orientation post, individual ones of the orientation bores oriented at a first angle with respect to a proximate one of the orientation bores and each is oriented perpendicular to the orientation post longitudinal axis. A retention assembly is releasably and co-axially received in the retention assembly receiving bore and one of the orientation bores. The retention assembly releasably connects the sign support post to the sign orientation post to permit selection of an axial angle of rotation of the sign support post with respect to the sign orientation post. A sign is connected to the sign support post and is positioned in either a stowed or a deployed condition. In the deployed condition a sign planar face is oriented at a second angle with respect to a longitudinal axis of the hitch extension tube.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 3:
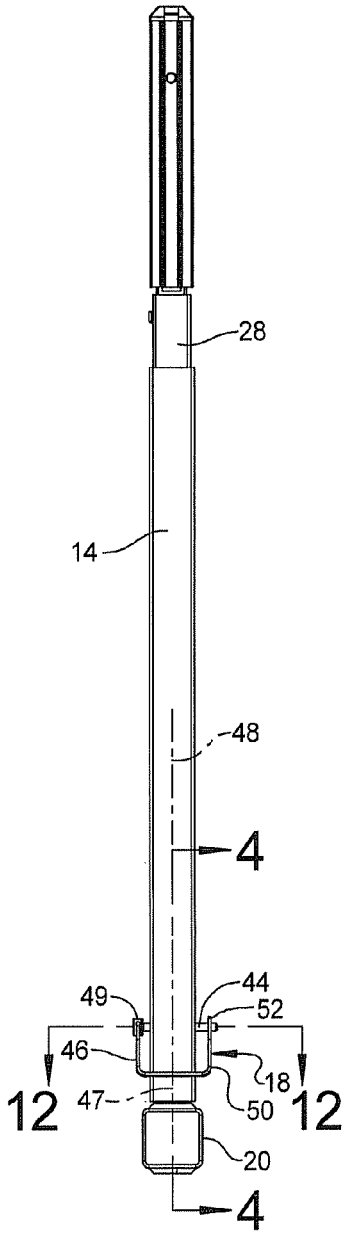
FIG. 3 is a front elevational view of the sign of FIG. 1.
Figure 9:
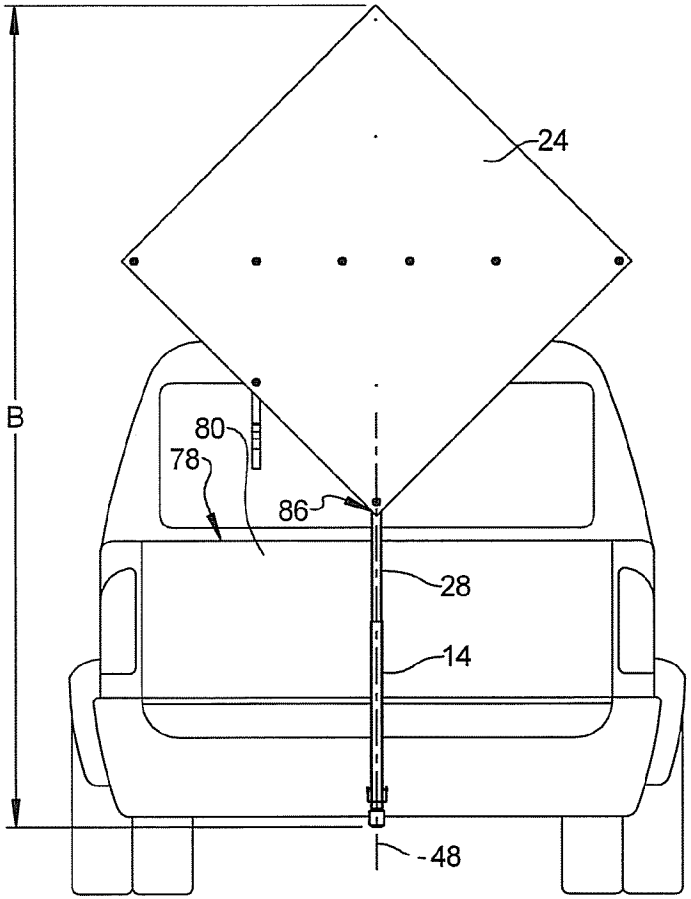
FIG. 9 is a rear elevational view of the vehicle of FIG. 6 having the sign in a fully deployed and extended condition.
Figure 11:
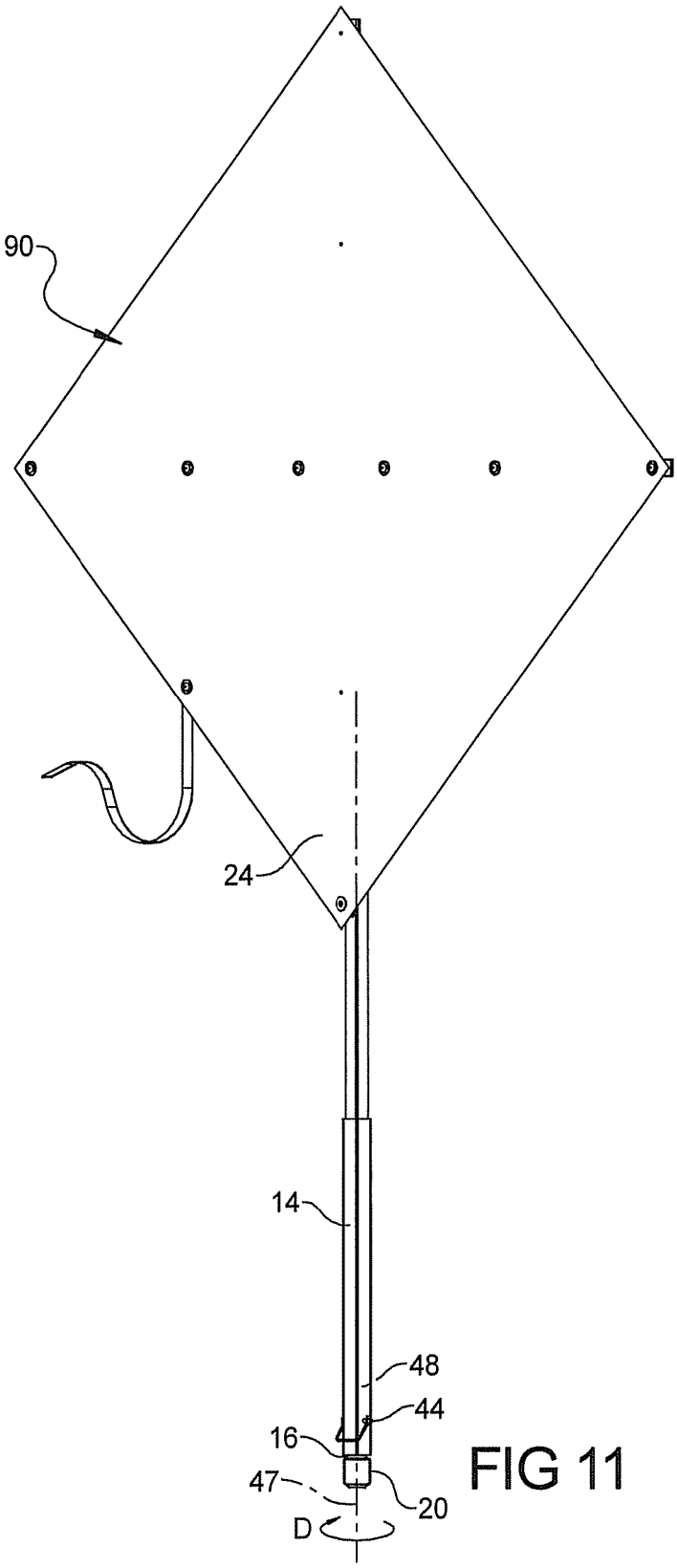
Figure 12:
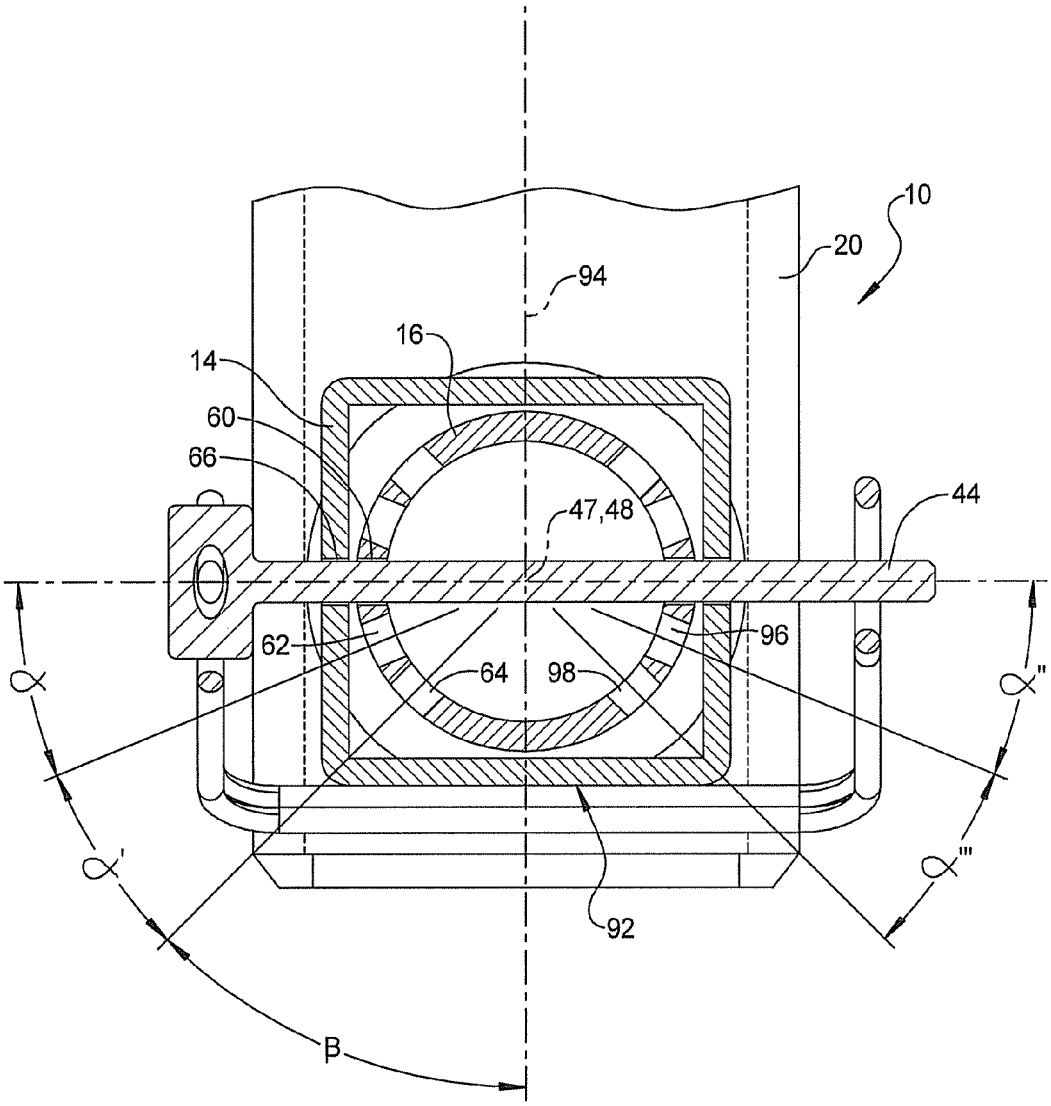
Figure 13:
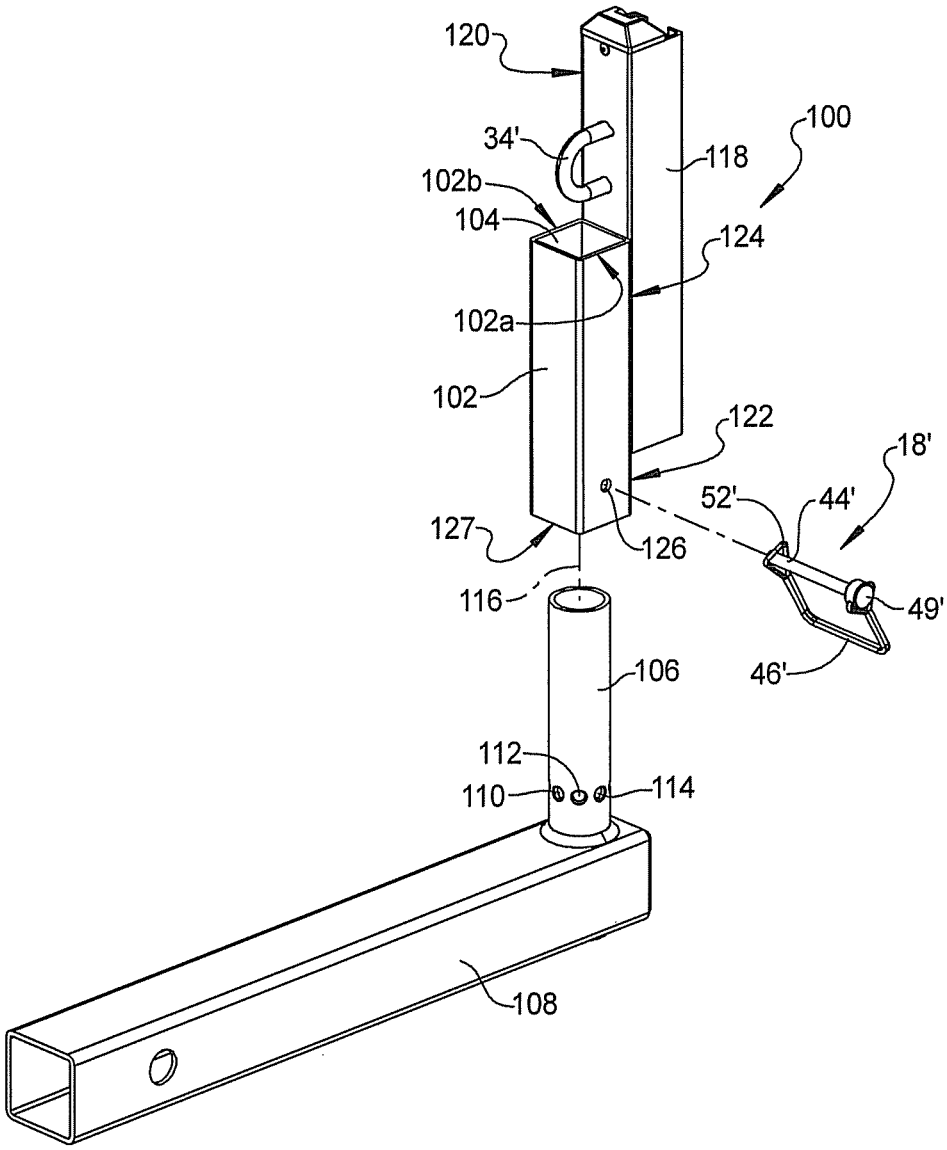
Figure 15:
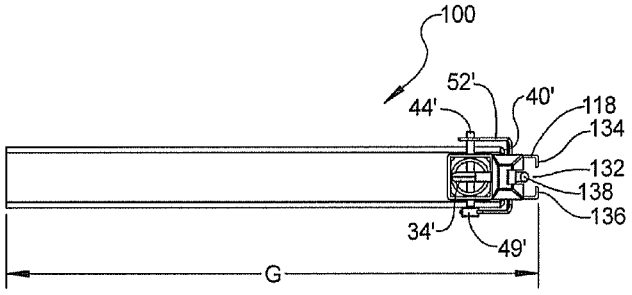
Figure 14:
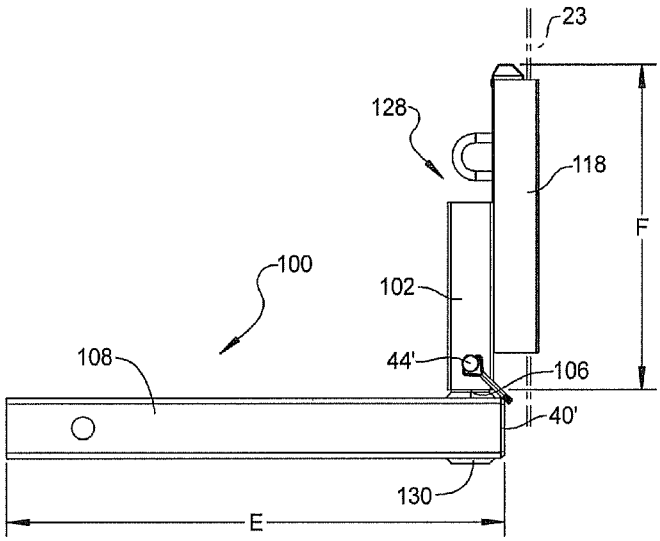

FIG. 11 a rear elevational view of the sign of FIG. 9 having the sign in a second axially rotated condition;

FIG. 12 is a cross sectional top plan view taken at section 12 of FIG. 3;

FIG. 13 is an exploded left front perspective view of a further embodiment of an adapter for a hitch mounted sign of the present disclosure;

FIG. 14 is a left side elevational view of the adapter of FIG. 13 in an assembled condition;

FIG. 15 is a top plan view of the assembled adapter of FIG. 14; and

Figure 16:
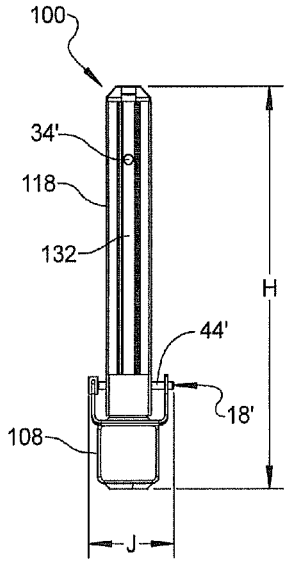

FIG. 16 is a front elevational view of the assembled adapter of FIG. 14.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
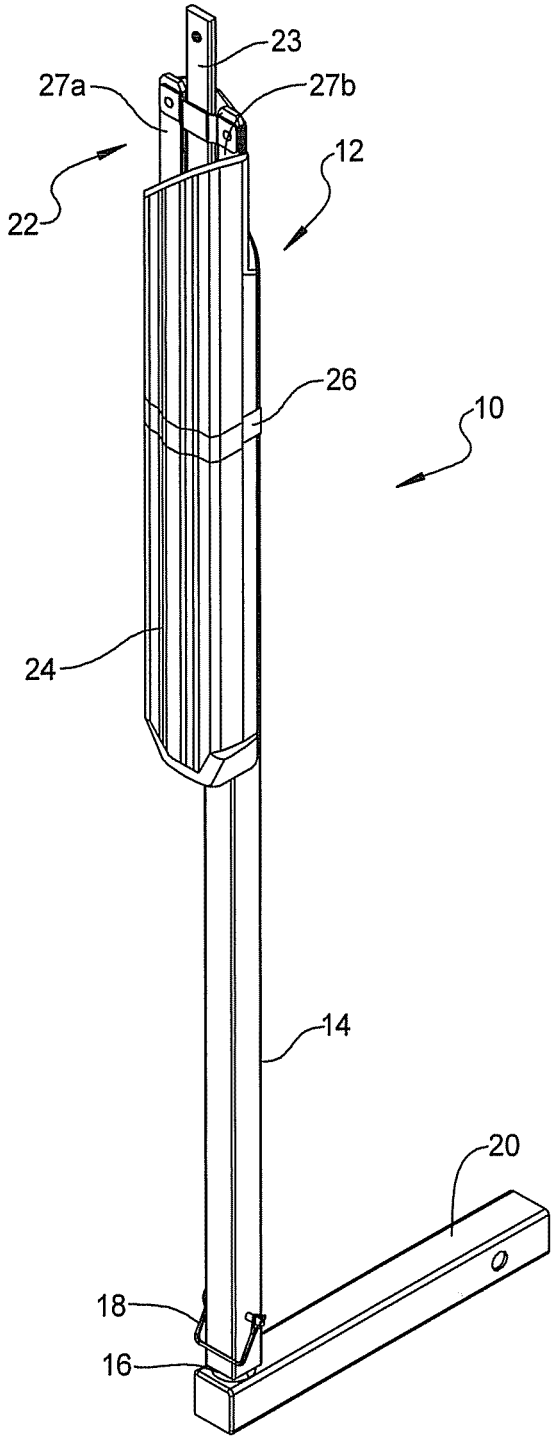
FIG. 1 is a right elevational perspective view of an adapter for a hitch mounted sign of the present disclosure.

Referring to FIG. 1, a sign mounting adapter system 10 includes a sign assembly 12 supported on a sign support post 14. According to several embodiments, sign support post 14 is oriented vertically upward to provide for a maximum extended height of sign assembly 12 to maximize visibility of the sign supported thereby, for example by passengers or drivers in vehicles passing construction or emergency sites. Sign support post 14 is axially and rotatably supported on a sign orientation post 16 and releasably retained at one of multiple orientation angles using a releasable retention assembly 18. Sign orientation post 16 is fixed in a perpendicular orientation with respect to a hitch extension tube 20, which is sized to be slidably received in a hitch assembly, as commonly known. For example, hitch extension tube 20 can be sized to be slidably received in a class 1, class 2, or class 3 hitch design.

Sign assembly 12 can include a sign frame 22, which can include a sign support rod 23. At least one sign 24 made from a flexible material, such as a polymeric material, is connected to sign frame 22 such that in the stowed condition, sign 24 will automatically fold and be retained with respect to sign support post 14. Retention can be accomplished using a strap or similar item as a retention member 26. Retention member 26 is released to allow sign 24 to be extended from the stowed condition shown. Sign frame 22 can be positioned having a plurality of extendable and retractable frame members 27*a*, 27*b* in a stowed condition as shown, or extended to a deployed condition, as will be described in better detail in reference to FIG. 8.

Figure 2:
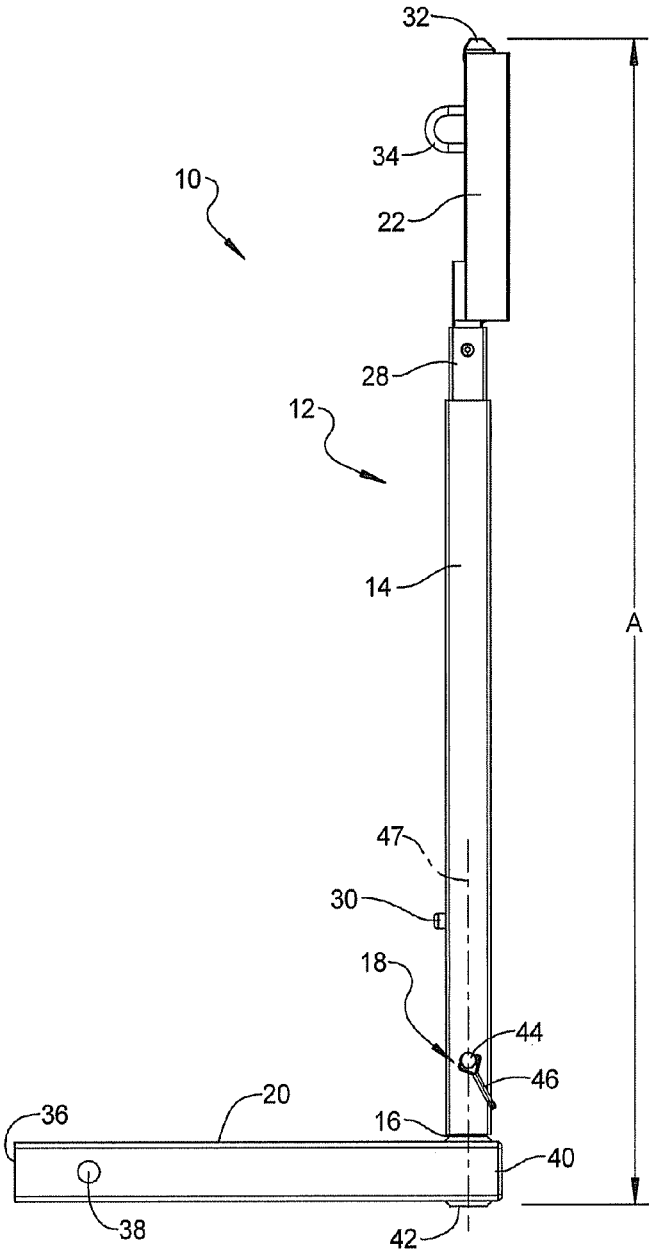
FIG. 2 is a left side elevational view of the sign of FIG. 1.

Referring to FIG. 2, sign mounting adapter system 10 can include additional members to permit a sign assembly minimum height "A" to be reached by downward sliding motion of sliding members provided with sign support post 14. According to several embodiments, an extension/retraction post 28 can be slidably received within sign support post 14 and positioned in the stowed position by extension of a first detent member 30 provided with extension/retraction post 28 slidably extending through sign support post 14 to retain extension/retraction post 28 in the stowed position. The stowed position provides for a major portion of a length of extension/retraction post 28 to be slidably received within sign support post 14. First detent member 30 can be pressed inwardly, with respect to sign support post 14, to release extension/retraction post 28 for subsequent vertical extension. According to several embodiments, sign frame 22 can further include a center post 32 having multiple component arms or features rotatably connected thereto. Extension or retraction of the members of sign frame 22 is permitted by releasably moving a bias member 34 used to retain sign frame 22 in the stowed condition shown.

Hitch extension tube 20 can include an extension tube insertion end 36 which is slidably received in a hitch receiver, shown and described with reference to FIG. 7. According to several embodiments, hitch extension tube 20 is rectangular or square in shape and includes a rod receiving aperture 38 defining a through-bore with respect to hitch extension tube 20 which slidably receives a hitch connecting rod to releasably engage hitch extension tube 20. A length of hitch extension tube 20 can be varied to suit a space envelope of sign assembly 12 and a space envelope required for full extension or deployment of sign frame 22.

According to several embodiments, an extension tube free end 40 of hitch extension tube 20 has a post extension portion 42 of sign orientation post 16 extending downwardly therefrom. A majority of a length of sign orientation post 16 is positioned above hitch extension tube 20 as shown in FIG. 2. To fix the axial orientation of sign support post 14 with respect to sign orientation post 16, a pin or similar retention member 44 of releasable retention assembly 18 is slidably received through both sign support post 14 and sign orientation post 16. According to several embodiments, releasable retention assembly 18 can further include a bale member 46 which helps retain retention member 44 in its installed position. A sign orientation post longitudinal axis 47 is oriented substantially perpendicular to the orientation of hitch extension tube 20.

Referring to FIG. 3 and again to FIG. 2, a sign support post longitudinal axis 48 of sign support post 14 is co-axially aligned with sign orientation post longitudinal axis 47 when sign support post 14 is rotatably received on sign orientation post 16. To help retain sign support post 14 at the desired axial rotation orientation with respect to sign orientation post 16, releasable retention assembly 18 further includes a pin head 49, which is larger in diameter than a diameter of retention member 44, to prevent further sliding displacement of retention member 44 after extending through both sign support post 14 and sign orientation post 16. Releasable retention assembly 18 further includes a U-shaped bale body 50 having a bale connecting end 52 which is positioned opposite to pin head 49 and is releasably engaged with the free end of retention member 44 that extends through sign support post 14. By assembly of releasable retention assembly 18 as shown, sign support post 14 is releasably engaged to sign orientation post 16 and also allows for ease of disassembly of the two posts.

Figure 4:
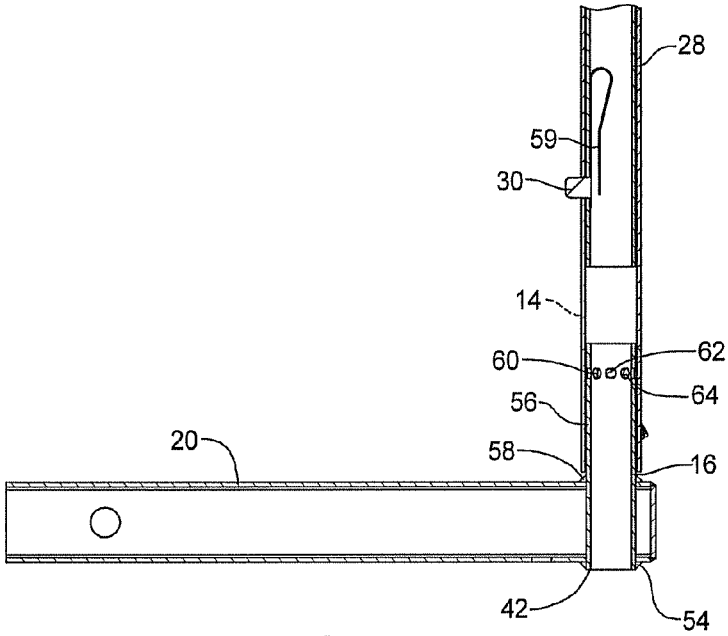
FIG. 4 is a left side cross sectional elevational view taken at section 4 of FIG. 3.

Referring to FIG. 4, post extension portion 42, which extends below hitch extension tube 20, can be fixed using a first weld joint 54. An orientation post body portion 56, extending predominantly above hitch extension tube 20, is received within a hollow, tubular section of sign support post 14. Orientation post body portion 56 can be fixed to hitch extension tube 20 using a second weld joint 58. The first detent member 30 is biased in its outwardly extended position shown by the biasing force of a detent biasing member 59 which is positioned within extension/retraction post 28. Multiple orientation bores are created as through-bores proximate a free end of sign orientation post 16. According to several embodiments, a first, second, and third orientation bore 60, 62, 64 are created through sign orientation post 16 and oriented at predetermined angles with respect to each other. For example, an angle $\alpha$ representing an angular displacement between bore axial centerlines of first and second orientation bores 60, 62 can range from approximately 20 degrees to approximately 45 degrees. Angle $\alpha$ can be repeated between any two successive ones of the orientation bores created through sign orientation post 16. Angle $\alpha$ can also be more than 45 degrees or less than 20 degrees when fewer than three orientation bores are used or when a quantity greater than three orientation bores is desired.

Sign frame 22 is releasably connected to sign support post 14 in the following manner. A male post end 68 of sign frame 22 is sized to be slidably received within a similarly shaped bore of a hollow post end 70 extending from sign support post 14. When male post end 68 is slidably received within hollow post end 70, a releasable connection can be created by the use of a second detent member 72 which is releasably received in a detent member bore 74 of hollow post end 70. Through the use of second detent member 72, sign frame 22 can be released from sign support post 14 to individually stow sign frame 22, or to replace sign frame 22 for a different sign application. Different sign applications can include signs having different surface areas, colors, messages, or the like.

Figure 6:
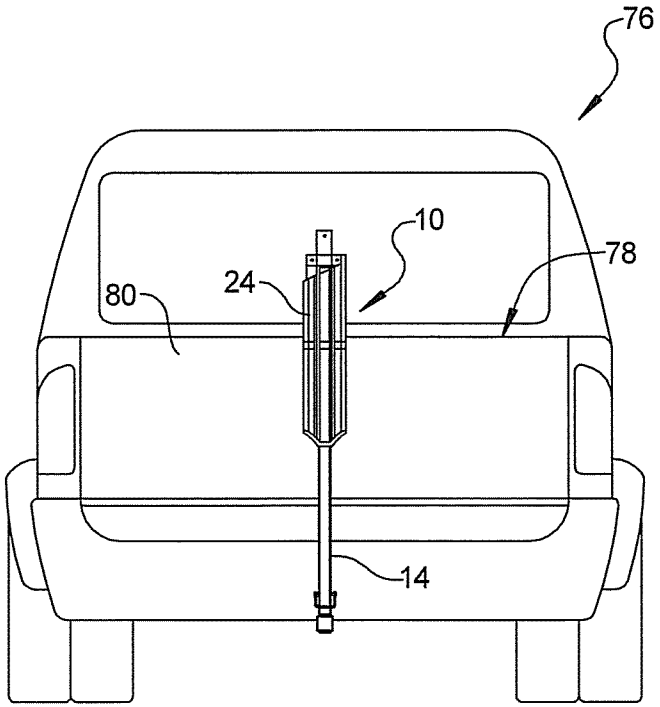
FIG. 6 is a rear elevational view of a vehicle having the sign of FIG. 1 mounted thereto.

Referring to FIG. 6, sign mounting adapter system 10 is shown in an exemplary application by installation on a vehicle 76, such as a pickup truck. In the stowed and retracted condition of sign 24, at least a portion of sign 24 is positioned below an upper tailgate surface 78 of a tailgate 80 of vehicle 76. This position reduces wind resistance and therefore reduces wind load created by sign 24 as vehicle 76 moves from one location to another.

Figure 7:
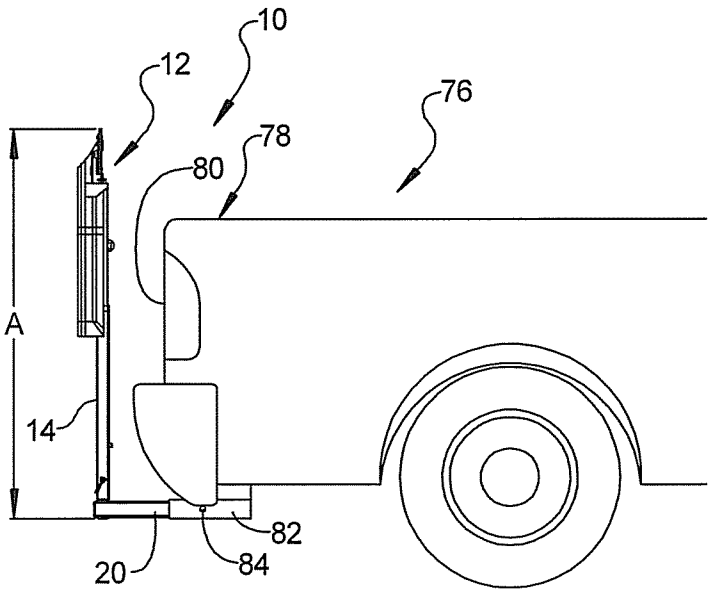
FIG. 7 is a right side elevational view of the vehicle of FIG. 6.

Referring to FIG. 7, the sign assembly minimum height "A" can be further controlled by varying a length of sign support post 14 if it is further desired to position sign assembly 12 completely below upper tailgate surface 78 during transport of sign assembly 12. Hitch extension tube 20 is shown in its installed position slidably received within a hitch receiver 82 fixed to structure of vehicle 76. A hitch connecting rod 84 is slidably received through both hitch receiver 82 and hitch extension tube 20 to releasably connect hitch extension tube 20. If further desired, a length of hitch extension tube 20 can be extended such that clearance is provided between tailgate 80 and both sign assembly 12 and sign support post 14. This additional clearance can provide access for rotating tailgate 80 downward and away from its upright position shown, for access to materials in a bed or internal area of vehicle 76.

Figure 8:
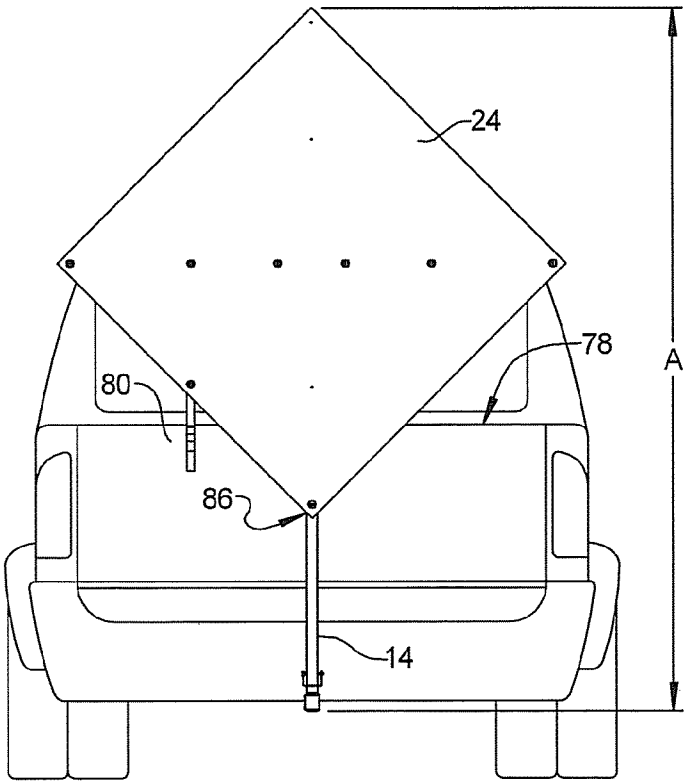
FIG. 8 is a rear elevational view of the vehicle of FIG. 6 having the sign in a fully deployed and retracted condition.

Referring to FIG. 8, sign 24 is shown in its fully deployed but non-extended condition while connected to sign support post 14. In this fully deployed but non-extended condition, a sign base 86 of sign 24 is positioned below upper tailgate surface 78 of tailgate 80. At the fully deployed but non-extended condition, sign 24 can be oriented substantially parallel to tailgate 80. Axial rotation of sign support post 14 rotating sign 24 away from the position parallel to tailgate 80 may be restricted based on the length of hitch extension tube 20 due to contact between sign 24 and tailgate 80.

Referring to FIG. 9, improved visibility of sign 24 can be provided by extending sign 24 vertically upward, as shown in FIG. 9, by axial extension of extension/retraction post 28. In the sign deployed and fully extended position shown, sign base 86 is positioned above upper tailgate surface 78 of tailgate 80. At this fully deployed and extended condition, sign 24 can also be axially rotated with respect to sign support post longitudinal axis 48. A sign assembly extended height "B" is established having all or substantially all of sign 24 positioned above upper tailgate surface 78.

Referring to FIG. 10 and again to FIG. 9, when sign mounting adapter system 10 is positioned having sign 24 in its fully deployed and extended condition, sign base 86 is positioned above upper tailgate surface 78. Sign 24 can be rotated to control the angle of visibility to sign 24 from a person or observer in the area of sign 24 by axially rotating sign support post 14 with respect to sign support post longitudinal axis 48. Retention member 44 is removed and re-aligned with a different one of the first, second, or third orientation bores 60, 62, 64 shown and described with reference to FIG. 5. Retention member 44 is then slidably replaced into the newly aligned ones of the orientation bore and pin receiving bore 66. In the exemplary embodiment shown, sign 24 is rotated from the position parallel to the vehicle tailgate 80 in a sign assembly first rotation direction "C", which is counterclockwise as viewed in FIG. 10. This rotation reorients a sign planar face 90 of sign 24 at an angle which better suits visibility by an observer of sign 24.

Figure 5:
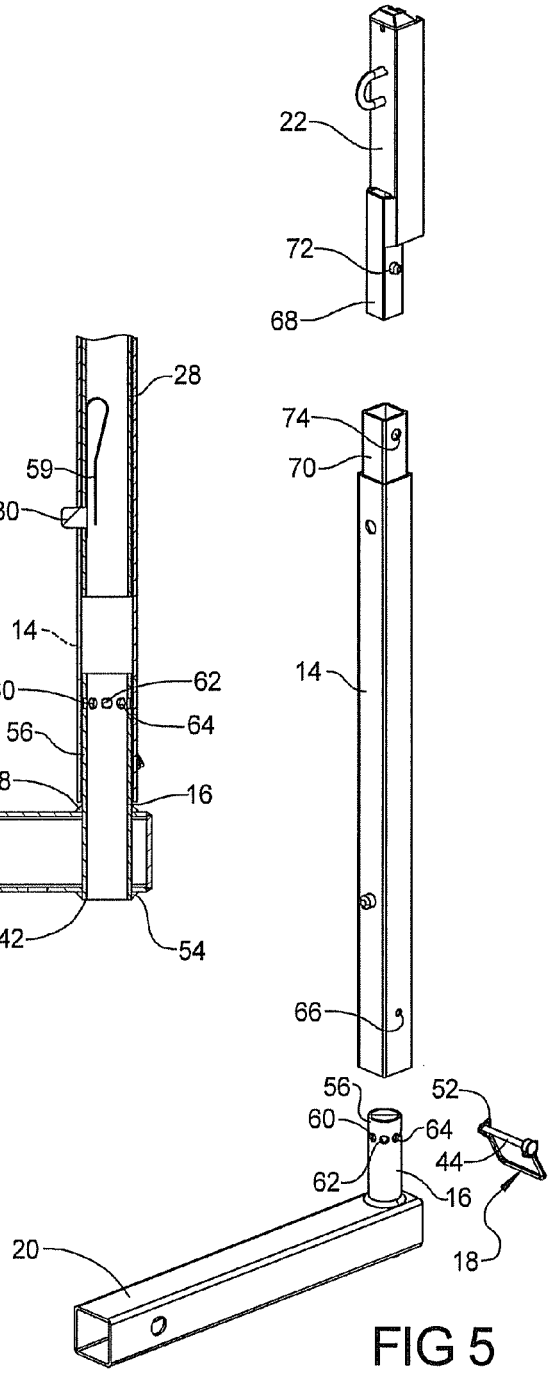
FIG. 5 is a front left elevational perspective view of the sign of FIG. 1.
Figure 10:
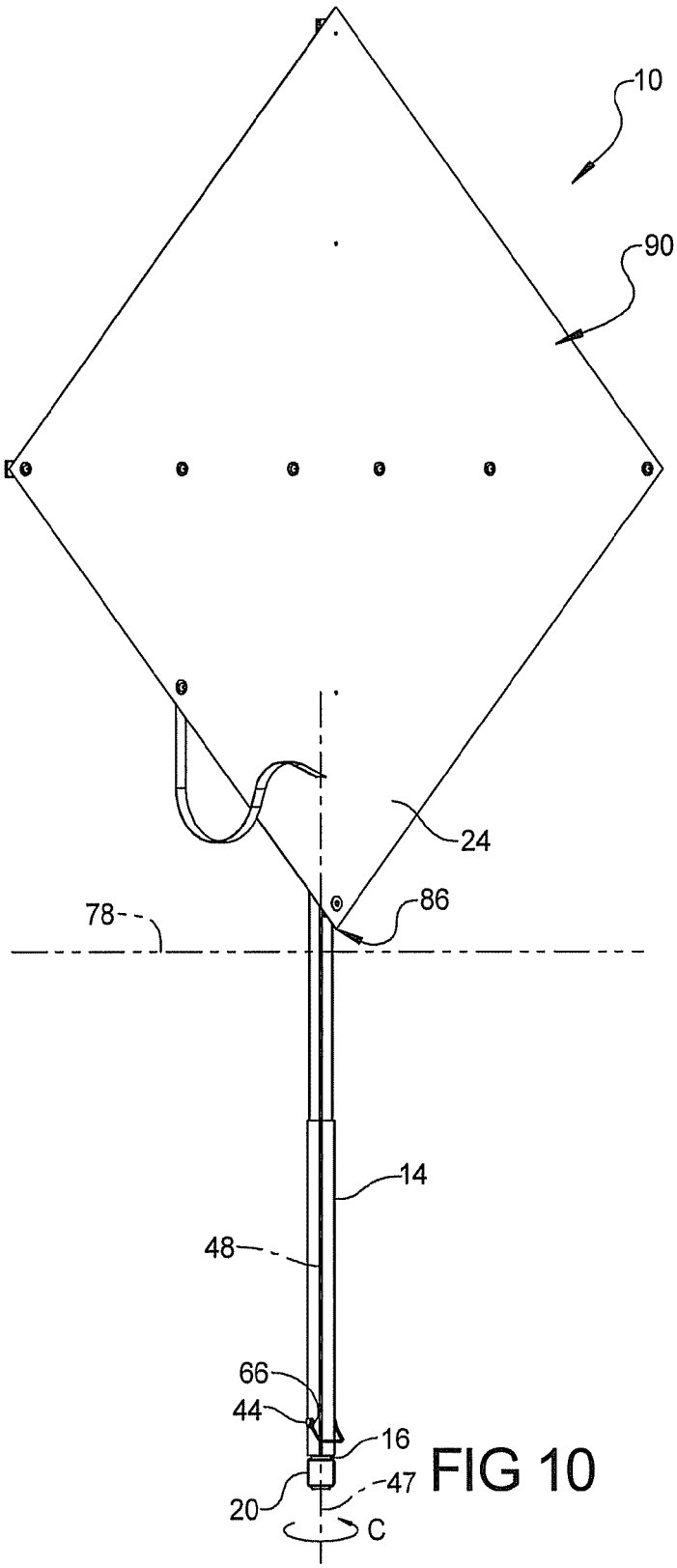
FIG. 10 is a rear elevational view of the sign of FIG. 9 having the sign in a first axially rotated condition.

Referring to FIG. 11 and again to FIGS. 10 and 9, sign 24 can also be oppositely rotated in a sign assembly second rotation direction "D" with respect to sign support post longitudinal axis 48. Again, retention member 44 is removed and sign support post 14 is axially rotated in the sign assembly second rotation direction "D". Retention member 44 is then reinserted to releasably retain the orientation of sign 24. In the embodiment shown in FIG. 11, sign assembly second rotation direction "D" is a clockwise direction and opposite to sign assembly first rotation direction "C", shown and described in reference to FIG. 10. With further reference to FIG. 5, sign 24 and sign support post 14 can also be rotated to an additional angular degree in either the clockwise or counterclockwise directions of sign assembly second or first rotation directions "D", "C" from either of the positions shown in FIG. 10 or 11, if the quantity of orientation bores created through sign orientation post 16 permit. As shown in FIG. 11, the sign planar face 90 of sign 24 is rotated to permit viewing by an observer positioned at a different perspective angle with respect to the orientation shown and described in reference to FIG. 10.

Referring to FIG. 12 and again to FIGS. 8-11, retention member 44 is slidably received entirely through pin receiving bore 66 of sign support post 14 and through first orientation bore 60 of sign orientation post 16. In this installed position of retention member 44, a post outer face 92 of sign support post 14 is oriented perpendicular to an extension tube longitudinal axis 94 of hitch extension tube 20. By removing retention member 44 and rotating sign support post clockwise as viewed in FIG. 12 to co-axially align a centerline of pin receiving bore 66 with a centerline of second orientation bore 62 and then reinserting retention member 44, post outer face 92 is rotated 22½ degrees clockwise from the position shown in FIG. 12. This corresponds to the orientation of sign 24 shown in FIG. 11. Similarly, by removing retention member 44 and rotating sign support post clockwise to co-axially align the centerline of pin receiving bore 66 with a centerline of third orientation bore 64 and then reinserting retention member 44, post outer face 92 is rotated 45 degrees clockwise from the position shown in FIG. 12.

Sign orientation post 16 can further include fourth and fifth orientation bores 96, 98 which are oriented at angles $\alpha''$ and $\alpha'''$, each substantially equal to angle $\alpha$. Angles $\alpha$, $\alpha'$, $\alpha''$ and $\alpha'''$ are herein described as 22½ degree angles, however, any angle up to and including 45 degrees can be selected for angles $\alpha$, $\alpha'$, $\alpha''$ and $\alpha'''$. By removing retention member 44 and rotating sign support post counter-clockwise as viewed in FIG. 12 to co-axially align the centerline of pin receiving bore 66 with a centerline of fourth orientation bore 96 and then reinserting retention member 44, post outer face 92 is rotated 22½ degrees counter-clockwise from the position shown in FIG. 12. This corresponds to the orientation of sign 24 shown in FIG. 10. Similarly, by removing retention member 44 and rotating sign support post counter-clockwise to co-axially align the centerline of pin receiving bore 66 with a centerline of fifth orientation bore 98 and then reinserting retention member 44, post outer face 92 is rotated 45 degrees counter-clockwise from the position shown in FIG. 12.

When the retention member 44 is received in both pin receiving bore 66 and one of the first, second or third orientation bores (60, 62, 64), the sign support tube 14 is oriented at a second angle beta ($\beta$) with respect to a longitudinal axis of the hitch extension tube 20. Second angle $\beta$ is calculated from the equation: Second angle $\beta$=(90 degrees−total angle $\alpha$). The second angle $\beta$ can therefore vary depending on which of the orientation bores retention member 44 is inserted through. In the embodiment of FIG. 12, second angle $\beta$ is 90 degrees with respect to a longitudinal axis of retention member 44 when received in first orientation bore 60. Second angle $\beta$ is 45 degrees with respect to the longitudinal axis of retention member 44 when retention member 44 is received in third orientation bore 64. If either angles $\alpha$ and $\alpha'$, or $\alpha''$ and $\alpha'''$ are both 45 degrees, angle $\beta$ will be zero.

The sign 24 can be positioned in each of a retracted stowed condition having the sign folded and the sign support post 14 in a retracted position as shown in FIG. 6, a fully deployed non-extended condition having the sign 24 fully deployed to a taught position and the sign support post 14 in a retracted position as shown in FIG. 8, and a fully deployed extended condition having sign 24 fully deployed to the taught position and the sign support post 14 and the extension/retraction post 28 fully axially extended with respect to the hitch extension tube 20 as shown in FIG. 9. In the fully deployed extended condition, sign 24 can also be rotated with respect to the longitudinal axis 48 of sign support post 14 as shown in both FIGS. 10 and 11.

Referring to FIG. 13 and again to FIG. 1, a sign mounting adapter system 100 is similar to sign mounting adapter system 10, therefore only the differences will be further discussed. Sign mounting adapter system 100 can be used to support a sign assembly similar to or modified with respect to support sign assembly 12 using a reduced height sign support post 102. According to several embodiments, sign support post 102 is oriented vertically upward and provides for a minimum height of the sign assembly 12 for applications where visibility of the sign does not require vertical extension for visibility, or for example when an obstruction may prevent use of the maximum height available for sign mounting adapter system 10.

Sign support post 102 can be rectangular in shape or other geometric shapes such as tubular, and includes a cavity 104 which permits sign support post 102 to be axially and rotatably received on a tubular-shaped sign orientation post 106. Sign support post 102 is reduced in length or height compared to sign support post 14. Similar to sign support post 14, sign support post 102 is releasably retained at one of multiple orientation angles using a releasable retention assembly 18'. Sign orientation post 106 is fixed to a hitch extension tube 108, which is sized to be slidably received in a vehicle hitch assembly as commonly known. For example, hitch extension tube 108 can be sized to be slidably received in a class 1, class 2, or class 3 hitch design. Retention member 44' of retention assembly 18' is removable and is aligned with one of first, second, or third orientation bores 110, 112, 114 which are similar to orientation bores 60, 62, 64. Sign 24 (shown in FIG. 1) or a smaller sign (not shown) can be rotated to control the angle of visibility to sign 24 from a person or observer in the area of sign 24 by axially rotating sign support post 102 with respect to a sign support post longitudinal axis 116.

With continuing reference to FIG. 13 and again to FIGS. 1-5, sign mounting adapter system 100 is further modified with respect to sign mounting adapter system 10 by eliminating extension/retraction post 28 and first detent member 30. A sign frame 118 is modified from sign frame 22 to provide for direct fixed connection of sign frame 118 to sign support post 102. A surface 120 of sign frame 118 is directly abutted with an oppositely directed face 122 of sign support post 102, and a weld joint 124 is created to fixedly connect sign support post 102 to sign frame 118. A pin receiving bore 126 created through opposite walls 102*a*, 102*b* of sign support post 102 is positioned closer to a first end 127 of sign support post 102 than the corresponding position of pin receiving bore 66 to minimize the length of both sign support post 102 and sign orientation post 106, while providing clearance between sign orientation post 106 and releasable bias member 34'. The releasable retention assembly 18' includes similar components to releasable retention assembly 18 and functions in the same manner when received through one of the first, second, or third orientation bores 110, 112, 114.

Referring to FIG. 14 and again to FIG. 13, an extension tube free end 40' of hitch extension tube 108 has a post extension portion 130 similar to post extension portion 42 extending downwardly from hitch extension tube 108, which can provide for an additional weld joint connecting sign orientation post 106 to hitch extension tube 108. In an assembled condition of sign mounting adapter system 100 shown, the sign orientation post 106 is positioned proximate to extension tube free end 40' to minimize a total length "E" of hitch extension tube 108. A total length "F" of a mounting assembly 128 having sign support post 102 and sign frame 118 is minimized in the design of sign mounting adapter system 100.

Referring to FIG. 15 and again to FIGS. 1 and 13-14, sign frame 118 of sign mounting adapter system 100 further includes opposed, L-shaped walls 134, 136 which define a longitudinal cavity 132. Cavity 132 can be used to slidably receive the sign support rod 23 of a sign such as sign 24. Cavity 132 is positioned vertically clear of extension tube free end 40' such that the sign support rod 23 when positioned in cavity 132 can extend below hitch extension tube 108 (as shown in phantom in FIG. 14) at any rotated position of sign support post 102 with respect to sign orientation post 106 retained by releasable retention assembly 18'. The bias member 34' includes a portion 138 that is extendable into and retractable out of cavity 132. Portion 138 when extended into cavity 132 acts to releasably engage the sign support rod 23. An adapter system length "G" of sign mounting adapter system 100 is equal to or less than the corresponding length of sign mounting adapter system 10.

Referring to FIG. 16 and again to FIGS. 1 and 13-15, an adapter system total height "H" of sign mounting adapter system 100 is fixed and less than the variable height provided for sign mounting adapter system 10. A bias member width "J" of retention member 44' can be greater than a width of hitch extension tube 108 to provide clearance to manually connect and disconnect bale connecting end 52'. With reference again to FIGS. 6 and 16, in the stowed and retracted condition of sign 24 when connected to sign mounting adapter system 100, the adapter system total height "H" is selected such that the entire sign 24 and the components of sign mounting adapter system 100 are positioned entirely below the upper tailgate surface 78 of tailgate 80 of vehicle 76. This position minimizes wind resistance and therefore minimizes wind load created by sign 24 as vehicle 76 moves from one location to another.

Sign mounting adapter systems 10 and 100 of the present disclosure permit a sign 24 to be rotated to different axial rotation angles with respect to a longitudinal axis of each of a sign support post and a sign orientation post to suit the position or orientation of the vehicle from which sign 24 is supported. For example, this permits the vehicle 76 to be temporarily parked on either a right hand side or a left hand side of a roadway, or the right hand side or the left hand side of an intersection with respect to an observer's vehicle entering the intersection, such that sign 24 is clearly visible to the observer even though vehicle 76 is not in the direct travel path of the observer. Sign mounting adapter system 10 can therefore be used by construction vehicles having temporary information signs rotated toward observers traveling through construction zones. Sign mounting adapter system 10 can also be used by emergency service personnel or vehicles in emergency areas to provide temporary instructions to an observer vehicle traveling through the emergency area.

With continuing reference to FIGS. 5,12 and 13, sign orientation posts 16, 106 have been previously described herein with reference to a circular post shape. Sign orientation posts 16, 106 can also be created in other geometric shapes, including but not limited to oval, square, rectangular, and the like, if sufficient clearance is provided between sign orientation posts 16, 106 and the internal walls of sign support posts 14 or 102 to allow axial rotation of sign support posts 14 or 102 with respect to sign orientation post 16 or 106. It is anticipated that alternate geometries to the circular shape for sign orientation posts 16, 106 can limit the quantity of orientation bores or the angle of orientation bores created through sign orientation post 16, 106. For the same reasons, if rotating clearances permit, similar alternate geometries for sign support post 14, 102 can also be used.

Referring again to FIGS. 1-3, according to further embodiments retention assembly 18 can be provided in multiple versions, including but not limited to: a nut/bolt combination, a threaded stud welded to the sign orientation post 16 with one or more slots created in the sign support post 14 receiving the threaded stud, such that the threaded stud position within the slot determines the rotation angle which can be releasably fixed using a nut; or a detent installed in or on the sign orientation post 16 received in one of a plurality of apertures created in the sign support post 14. Other embodiments of retention assembly 18 can include: a threaded nut connected to the sign support post 14 having a threaded shank member (such as a thumb screw) threaded into the nut and through the sign support post 14 to releasably contact the sign orientation post 16, and a welded nut on a lower portion of the sign support post 14 receiving a threaded and bent rod to releasably provide the angular orientation. Still other embodiments of retention assembly 18 can include a raised surface treatment such as a knurling applied to sign orientation post 16 and/or sign support post 14 that together with a threaded fastener such as a thumb screw frictionally and rotatably orients the sign support post 14 at the desired angular orientation.

Sign mounting adapter systems of the present disclosure offer several advantages. By permitting a sign to be axially rotatably oriented with respect to a support post connected to the rear of a vehicle using a standard hitch mount design, the information provided on the sign can be viewed by observers from different orientation angles than the vehicle supporting the sign can oriented to. By permitting a sign support post to be axially rotated with respect to a sign orientation post, the vertically configured sign support post and a sign it supports can be axially co-rotated. By further extension to a fully deployed and fully extended condition, clearance is provided between the sign and a tailgate of the vehicle supporting the sign. By further use of an extension/retraction post 28 slidably received in the sign support post 14, a stowed condition of the sign 24 can also be provided which minimizes sign wind resistance during vehicle travel to parking position. This permits the sign assembly 12 to be retained in its connected condition with the vehicle either during transportation of the vehicle or for deployment of the sign.

The foregoing description of various embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sign mounting adapter system, comprising:

a hitch extension tube;

a sign orientation post fixedly connected to the hitch extension tube, the sign orientation post having multiple orientation bores individually extending through the sign orientation post; and a sign support post co-axially disposed on and rotatably supported by the sign orientation post to permit selection of one of multiple predetermined axial angles of rotation of the sign support post with respect to the sign orientation post each corresponding to one of the orientation bores.

2. The sign mounting adapter system of claim 1, wherein the multiple orientation bores individually extending through the sign orientation post are individually oriented at an angle with respect to a proximate one of the orientation bores.

3. The sign mounting adapter system of claim 2, further including a receiving bore created in the sign support post axially alignable with a selected one of the multiple orientation bores.

4. The sign mounting adapter system of claim 3, further including a retention assembly releasably and co-axially received in the receiving bore and the selected one of the orientation bores, the retention assembly operating to releasably connect the sign support post to the sign orientation post.

5. The sign mounting adapter system of claim 3, wherein the receiving bore is oriented perpendicular to a sign support post longitudinal axis.

6. The sign mounting adapter system of claim 2, wherein the sign orientation post has a longitudinal axis co-axially aligned with a sign support post longitudinal axis.

7. The sign mounting adapter system of claim 6, wherein each of the orientation bores is oriented perpendicular to the sign orientation post longitudinal axis.

8. The sign mounting adapter system of claim 1, wherein the sign orientation post is fixed to and oriented perpendicular to the hitch extension tube.

9. The sign mounting adapter system of claim 1, wherein the hitch extension tube is releasably connected to a hitch assembly of a vehicle such that the hitch extension tube extends horizontally and both the sign orientation post and sign support post extend vertically upward from the hitch extension tube.

10. The sign mounting adapter system of claim 1, further including a sign assembly having a flexible material sign extendable therefrom, the sign positioned in each of a retracted stowed condition having the sign folded and the sign support post in an axially downward retracted position, a fully deployed non-extended condition having the sign fully deployed to a taught position and the sign support post in the retracted position, and a fully deployed extended condition having the sign fully deployed to the taught position and the sign support post fully axially extended with respect to the hitch extension tube.

11. The sign mounting adapter system of claim 1, further including a sign assembly having a rigid sign supported therefrom.

12. The sign mounting adapter system of claim 1, further including a retention assembly releasably connecting the sign support post to the sign orientation post at the axial angle of rotation using at least a threaded member.

13. A sign mounting adapter system, comprising:

a hitch extension tube;

a sign orientation post connected to the hitch extension tube;

a sign support post co-axially disposed on and rotatably supported by the sign orientation post to permit selection of an axial angle of rotation of the sign support post with respect to the sign orientation post;

a sign frame fixed to the sign support post having a longitudinal cavity sized to slidably receive a sign support rod of a sign member; and the hitch extension tube including an extension tube free end, the cavity being positioned vertically clear of the extension tube free end such that the sign support rod when positioned in the cavity is extendable clear of the extension tube free end and below the hitch extension tube.

14. The sign mounting adapter system of claim 13, further including multiple orientation bores individually extending through the sign orientation post.

15. The sign mounting adapter system of claim 14, further including a bore extending through opposed walls of the sign support post, the bore being axially alignable with a selected one of the multiple orientation bores to determine the axial angle of rotation.

16. The sign mounting adapter system of claim 14, wherein each of the orientation bores is oriented at an angle with respect to a proximate one of the orientation bores.

17. The sign mounting adapter system of claim 13, further including a surface of the sign frame directly abutted with an oppositely directed face of the sign support post, and a weld joint created to fixedly connect the sign support post to the sign frame.

18. The sign mounting adapter system of claim 13, further including a bias member having a portion extending into the cavity to releasably engage the sign support rod.

19. A sign mounting adapter system, comprising:

a hitch extension tube;

a sign orientation post connected to the hitch extension tube;

a sign support post co-axially disposed on and rotatably supported by the sign orientation post to permit selection of an axial angle of rotation of the sign support post with respect to the sign orientation post; and a sign frame fixed to the sign support post having a longitudinal cavity sized to slidably receive a sign support rod of a sign member;

wherein the sign frame further includes opposed L-shaped walls which define the longitudinal cavity therebetween and which further slidably retain the sign support rod.

20. A sign mounting adapter system, comprising:

a sign orientation post having a sign orientation post longitudinal axis;

a sign support post co-axially and rotatably received on the sign orientation post, the sign support post having a sign support post longitudinal axis co-axially aligned with the sign orientation post longitudinal axis and a retention assembly receiving bore;

multiple orientation bores extending through the sign orientation post, each oriented at an angle with respect to a proximate one of the orientation bores; and a retention assembly releasably and co-axially received in the retention assembly receiving bore and one of the orientation bores to releasably connect the sign support post to the sign orientation post and to permit selection of one of multiple axial angles of rotation of the sign support post with respect to the sign orientation post predefined by the one of the orientation bores selected.

21. The sign mounting adapter system of claim 20, wherein each of the orientation bores is further oriented at a second angle with respect to a hitch extension tube, the second angle being a multiple of the first angle.

22. The sign mounting adapter system of claim 20, wherein the sign orientation post is oriented perpendicular to a hitch extension tube.

23. The sign mounting adapter system of claim 20, wherein the retention assembly receiving bore is oriented perpendicular to the sign support post longitudinal axis.

24. The sign mounting adapter system of claim 20, wherein each of the orientation bores is oriented perpendicular to the orientation post longitudinal axis.

25. The sign mounting adapter system of claim 20, further including a hitch extension tube, the sign orientation post fixedly connected to the sign orientation post and oriented perpendicular to the hitch extension tube.

26. The sign mounting adapter system of claim 20, wherein the sign support post is rotatable in either a clockwise or a counterclockwise direction.

27. A sign mounting adapter system, comprising:

a hitch extension tube adapted for releasable connection to a hitch receiver of a vehicle;

a sign orientation post fixed to and oriented perpendicular to the hitch extension tube, the sign orientation post having a sign orientation post longitudinal axis;

a sign support post co-axially and rotatably received on the sign orientation post, the sign support post having a sign support post longitudinal axis co-axially aligned with the sign orientation post longitudinal axis and a pin receiving bore oriented perpendicular to the sign support post longitudinal axis;

multiple orientation bores extending through the sign orientation post, individual ones of the orientation bores oriented at an angle with respect to a proximate one of the orientation bores and each of the orientation bores oriented perpendicular to the orientation post longitudinal axis;

a pin releasably and co-axially received in the retention assembly receiving bore and one of the orientation bores, the pin operating to releasably connect the sign support post to the sign orientation post and to permit selection of an axial angle of rotation of the sign support post with respect to the sign orientation post; and a sign connected to the sign support post and positioned in either a stowed or a deployed condition, the deployed condition having a sign planar face oriented at a second angle with respect to a longitudinal axis of the hitch extension tube; and an adapter system total height is selected such that both the sign and the hitch extension tube sign mounting adapter system are positioned entirely below an upper tailgate surface of a pickup truck tailgate.

28. The sign mounting adapter system of claim 27, wherein the pin is included in a releasable fastener assembly, the releasable fastener assembly further including:

a pin head integrally connected to the pin;

a bale member connected to the pin head; and a bale connecting end releasably positioned at a free end of the pin preventing the pin from sliding freely out of the retention assembly receiving bore.

29. A sign mounting adapter system, comprising:

a hitch extension tube adapted for releasable connection to a hitch receiver of a vehicle;

a sign orientation post fixed to and oriented perpendicular to the hitch extension tube, the sign orientation post having a sign orientation post longitudinal axis;

a sign support post co-axially and rotatably received on the sign orientation post, the sign support post having a sign support post longitudinal axis co-axially aligned with the sign orientation post longitudinal axis and a pin receiving bore oriented perpendicular to the sign support post longitudinal axis;

multiple orientation bores extending through the sign orientation post, individual ones of the orientation bores oriented at an angle with respect to a proximate one of the orientation bores and each of the orientation bores oriented perpendicular to the orientation post longitudinal axis;

a pin releasably and co-axially received in the retention assembly receiving bore and one of the orientation bores, the pin operating to releasably connect the sign support post to the sign orientation post and to permit selection of an axial angle of rotation of the sign support post with respect to the sign orientation post; and a sign connected to the sign support post and positioned in either a stowed or a deployed condition, the deployed condition having a sign planar face oriented at a second angle with respect to a longitudinal axis of the hitch extension tube;

wherein the second angle is calculated from the equation: second angle=(90 degrees−first angle).

* * * * *